United States Patent [19]

Tabron

[11] 4,081,796

[45] Mar. 28, 1978

[54] FIRE ALARM DETERRENT

[76] Inventor: Prymas M. Tabron, 1625 Shadyside Rd., Baltimore, Md. 21218

[21] Appl. No.: 795,646

[22] Filed: May 10, 1977

[51] Int. Cl.[2] ..... G08B 15/02

[52] U.S. Cl. ..... 340/304; 220/18; 174/66

[58] Field of Search ..... 220/18, 3.8; 174/66, 174/67; 340/287, 304

[56] References Cited

U.S. PATENT DOCUMENTS

| | | | |
|---|---|---|---|
| 2,106,849 | 2/1938 | Long | 340/304 |
| 3,877,005 | 4/1975 | Apgar | 340/304 |

*Primary Examiner*—George T. Hall

*Attorney, Agent, or Firm*—John F. McClellan, Sr.

[57] ABSTRACT

A housing for fire alarm boxes which positively marks a person turning in an alarm, frustrates attempts to use a hook or other tool in place of the hand for actuating an alarm, and which permits rapid actuation of the alarm but slows withdrawal of the hand from the housing; the housing forms an enclosure around and below an alarm box large enough for access of a hand upward from the bottom; a dye-covered resilient door at the bottom affixed to the front of the housing extending up and toward the bottom of the fire alarm box guards the access to the alarm, and must be deflected upwardly forcefully by a hand reaching for the alarm; withdrawal of the hand requires simultaneously a slow twisting of the hand to free it from the edge of the resilient door; the twisting covers all parts of the hand with dye so that evidence of turning in the alarm cannot be concealed short of concealing the entire hand.

5 Claims, 3 Drawing Figures

FIRE ALARM DETERRENT

This invention relates generally to alarm systems and specifically to systems for preventing false alarms.

Danger and disruption caused by false alarms occur with increasing frequency today, particularly in schools.

Principal objects of this invention are to provide the simplest most trouble free, economical and easy to install false alarm guard and identifier.

In the prior art, U.S. Pat. No. 3,877,005 granted John C. Apgar on Apr. 8, 1975, discloses a fire alarm box with a housing having a connection between the alarm handle and a spray for dye or the like to identify the hand of a person turning in an alarm; U.S. Pat. No. 2,909,767 granted to S. Zaltman on Oct. 20, 1959 discloses spraying with dye persons who break an infrared beam. Various complicated devices are known for capturing and holding people turning in alarms, some of which hold for specific intervals and then release, and the use of dye in rub-off applications for identification is known.

However, it is believed that the present invention combines in unique coaction not fairly suggested in the prior art, unitary structure which at once shields and protects fire alarm boxes, marks on all sides the hand of the person sounding an alarm, and makes it extremely uncomfortable to withdraw the hand quickly after sounding an alarm.

In brief summary given for cursive description only and not as limitation the invention includes a housing having at the bottom a resilient door angled to permit rapid passage of a hand reaching in one direction for a fire alarm actuator and to encourage slow withdrawal of the hand and require twisting dye over substantially the entire hand withdrawn.

The above and other objects and advantages of the invention will become more readily appreciated on examination of the following description, including the drawings in which like reference numerals indicate like parts.

FIG. 1 shows the invention 10 in place protecting a conventional fire alarm box F (phantom lines) such as those used in schools, against the sounding of false alarms.

Figure 1:
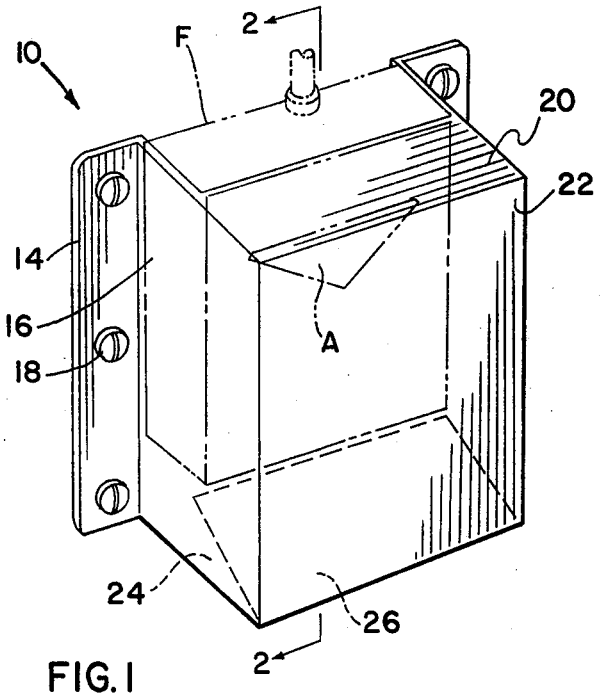
FIG. 1 is an isometric view of the invention installed at a fire alarm box.

The housing sidewalls closely enclose the fire alarm box.

A pair of out-turned flanges 14 on the housing sidewalls 16 mount to building structure by means of screws 18 or the like. A top 20 on the generally rectangular housing prevents access from above to the fire alarm box. The front wall 22 is spaced out from the fire alarm box a distance sufficient for a hand to be thrust up from below to sound an alarm, as by forcing downward an alarm sounding handle A with the fingers.

The housing has a full width bottom opening 24 guarded by a door 26; the door fills the width of the opening.

Figure 2:
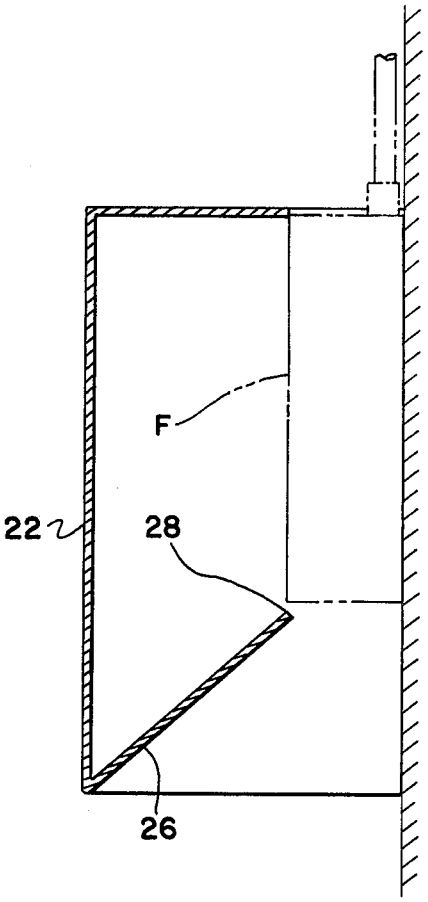
FIG. 2 is a section taken at 2—2, FIG. 1.

FIG. 2 shows that the door inclines upward away from attachment to the front wall lower edge so that the free edge 28 of the door lies just below the fire alarm box and overlaps it in bottom plan view to prevent passage of coathangers or other hooks which might be used in attempts to sound false alarms.

Figure 3:
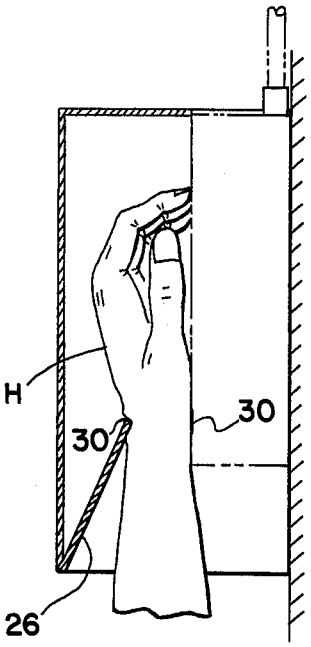
FIG. 3 is a section similar to FIG. 2 showing operation of the invention.

FIG. 3 shows that resilient deflection upward swings the door in an arc just clearing the fire alarm box; for this a manual pressure of a pound or so is preferably required. A hand H passes easily upward and the fingers can force the fire alarm handle down.

However the resilient force of the free edge of the door holds the hand against the box when withdrawal is attempted, making straight-down withdrawal painful, so that the hand must be twisted during withdrawal. Rub-off dye 30 applied to the free edge and preferably to the fire alarm box front as well smears broadly over the hand during twisting. To emphasize the painful effect the free edge may be square-cut rather than rounded, if desired. The angle of upward inclination of the door is preferably about 45° when undeflected.

Resilience is sufficient if the unit is made of mild steel of 16 to 24 gauge, but some degree of temper is preferable.

In conclusion, it can be seen that the invention provides a safe, positive deterrent by means of a minimum-cost, durably self-protecting structure, the sharp corners of the door being against the sides and the door edges being upwardly recessed except for the attaching edge which is preferably continuous with the front. The door and the top and the relation to the fire alarm box stiffen the structure against impact damage. Finally, the dye location on the areas around the free edge, front, back and edge, and within the enclosure on the front of a fire alarm box protects against accidental ruboff or tampering to remove it.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent is:

1. In a guard against false alarms employing a housing for covering a fire alarm box and having dye associated with a portion thereof for marking the hand of a person sounding an alarm, the improvement comprising: the housing having structure, including a front wall, proportioned for forming an enclosure around a fire alarm box with the front wall spaced out a distance permitting manual access for fire alarm sounding, said structure defining an opening in the housing bottom; a door having a free edge, the door resiliently affixed across said opening with the free edge at an upwardly inclined angle, the door proportioned for requiring an upward deflection of the free edge to produce manual access for fire alarm sounding, said resilient affixing of the door requiring sufficient force for said upward deflection for causing the free edge to produce a painful pressure on the hand of a person withdrawing a hand from the housing unless the hand is twisted during withdrawal, and the dye being applied adjacent the free edge of the door in position for spreading on a hand being twisted.

2. In a guard as recited in claim 1, said door filling the width of the opening and said affixation being at the lower portion of the front wall.

3. In a guard as recited in claim 2, the door being integral with the front wall.

4. In a guard as recited in claim 2, the door being proportioned for overlapping a fire alarm box in bottom plan view when undeflected.

5. In a guard as recited in claim 4, a pair of flanges for supporting the guard, and top structure proportioned for preventing access to a fire alarm box.

* * * * *